US010222156B2

(12) United States Patent
Head

(10) Patent No.: US 10,222,156 B2
(45) Date of Patent: Mar. 5, 2019

(54) SPEED LOADERS AND ASSEMBLIES FOR LOADING CARTRIDGES IN REVOLVER CYLINDERS

(71) Applicant: Vulcan Ballistic Products, LLC, Greenville, SC (US)

(72) Inventor: Thomas S. Head, Greenville, SC (US)

(73) Assignee: VULCAN BALLISTIC PRODUCTS, LLC, Greenville, SC (US)

( * ) Notice: Subject to any disclaimer, the term of this patent is extended or adjusted under 35 U.S.C. 154(b) by 0 days.

(21) Appl. No.: 15/497,611

(22) Filed: Apr. 26, 2017

(65) Prior Publication Data

US 2018/0313621 A1 Nov. 1, 2018

(51) Int. Cl.
*F41A 9/85* (2006.01)

(52) U.S. Cl.
CPC ..... *F41A 9/85* (2013.01)

(58) Field of Classification Search
CPC ..... F41A 9/85; F41A 9/82; F41A 15/02
USPC ..... 42/89, 87, 88
See application file for complete search history.

(56) References Cited

U.S. PATENT DOCUMENTS 527,166 A * 10/1894 Watson ..... F41A 9/85 42/89
1,655,624 A 1/1928 Nelson
1,891,437 A * 12/1932 Milmore ..... F41A 9/85 42/89
1,929,440 A * 10/1933 Miano ..... F41A 9/85 42/89
1,964,171 A 6/1934 Pflaume
1,969,817 A * 8/1934 Milmore ..... F41A 9/85 42/89
2,073,436 A * 3/1937 Woodhead ..... F41A 9/85 42/89
2,399,904 A * 5/1946 Baucum ..... F41A 9/85 224/239
2,406,232 A 8/1946 Consuegra
2,592,415 A * 4/1952 Grogan ..... F41A 9/83 224/239
2,620,584 A * 12/1952 Edmands ..... F41A 9/85 42/89
2,896,353 A * 7/1959 Hunt ..... F41A 9/85 42/89
3,057,103 A * 10/1962 Bivens ..... F41A 9/85 42/89

(Continued)

OTHER PUBLICATIONS

Speedbeez, Internet Website; http://www.speedbeez.com/ printed Oct. 29, 2015; 3 pages.

(Continued)

*Primary Examiner* — Joshua E Freeman
(74) *Attorney, Agent, or Firm* — Dority & Manning, P.A.

(57) ABSTRACT

Speed loaders and assemblies for loading cartridges in revolver cylinders are provided. A speed loader assembly for loading cartridges in a revolver cylinder includes a speed loader, the speed loader including a body which defines a plurality of passages, each of the plurality of passages configured to accommodate a cartridge therein. The speed loader assembly further includes a protective casing removably connectable to the speed loader, the casing including a sidewall defining an interior and having a closed polygonal cross-sectional profile. Portions of cartridges extending from the passages are encased by the protective casing.

7 Claims, 12 Drawing Sheets

(56) References Cited

U.S. PATENT DOCUMENTS 3,066,791 A * 12/1962 Bivens ..... F42B 39/02 206/3
3,131,500 A * 5/1964 Buchwalder ..... F41A 9/85 224/666
3,150,459 A 9/1964 Schoick
3,213,559 A * 10/1965 Matich ..... F41A 9/85 206/3
3,225,482 A * 12/1965 Olson ..... F41A 9/85 42/89
3,252,238 A 5/1966 Bye
3,503,150 A 3/1970 Bye
3,541,716 A 11/1970 Fordham
3,769,733 A * 11/1973 Nelson ..... F41A 9/85 224/239
3,923,152 A * 12/1975 Minneman ..... B25H 3/003 206/3
3,955,301 A 5/1976 Wiethoff
3,990,170 A * 11/1976 Griffis ..... F41A 9/83 206/3
4,030,222 A 6/1977 Sommer
4,065,868 A 1/1978 Johnson
4,079,536 A 3/1978 Hunt
4,133,129 A 1/1979 Jelinek et al.
4,202,124 A 5/1980 Switzer
4,229,896 A 10/1980 Jurich, III
4,254,571 A 3/1981 Peter et al.
4,272,903 A 6/1981 Griffis
4,313,275 A 2/1982 Switzer
4,325,198 A 4/1982 Muck et al.
4,402,153 A 9/1983 Peter et al.
4,408,707 A * 10/1983 Rogers ..... F42B 39/02 224/239
4,437,252 A 3/1984 Castellanos Manero
4,507,889 A 4/1985 Allen
4,509,284 A 4/1985 Naber
4,535,558 A 8/1985 Benesh
4,572,415 A * 2/1986 Fehr ..... F41A 9/85 224/675
4,657,132 A * 4/1987 Abdo ..... F42B 39/02 206/3
4,697,369 A 10/1987 Spears
4,756,110 A 7/1988 Beltron
4,796,371 A 1/1989 Daniels
4,862,622 A 9/1989 Goyanes
4,866,870 A 9/1989 Johnson
4,869,009 A 9/1989 Bennett
5,548,916 A 8/1996 Kinsel
5,621,998 A 4/1997 Norgaard
5,842,299 A 12/1998 Switzer et al.
5,953,845 A 9/1999 Longwitz
6,308,451 B1 10/2001 Koledey
6,688,504 B1 * 2/2004 Kirkaldy ..... A45F 5/021 224/196
7,363,845 B2 4/2008 McClellan
8,136,285 B2 3/2012 Abell et al.
8,931,633 B2 1/2015 Martin, III
9,103,626 B1 * 8/2015 Heizer ..... F41C 23/22
D753,260 S * 4/2016 Solovov, Jr. ..... D22/116
2007/0044363 A1 * 3/2007 McClellan ..... F41A 9/85 42/87
2009/0229161 A1 * 9/2009 Austin ..... F41A 9/85 42/89
2010/0313460 A1 * 12/2010 Tucker ..... F41A 9/83 42/87
2014/0124387 A1 * 5/2014 Iannello ..... F42B 39/02 206/3
2014/0202884 A1 * 7/2014 Martin, III ..... F41A 9/85 206/3
2015/0027023 A1 * 1/2015 Michael ..... F41A 9/24 42/88
2017/0122683 A1 * 5/2017 Head ..... F41A 9/85

OTHER PUBLICATIONS

Vulcan Ballistic Products, LLC, International Patent Application No. PCT/US2016/054701; International Search Report dated Dec. 8, 2016; (5 pages).

* cited by examiner

SPEED LOADERS AND ASSEMBLIES FOR LOADING CARTRIDGES IN REVOLVER CYLINDERS

FIELD OF THE INVENTION

The present disclosure relates generally to speed loaders for loading cartridges into the cylinders of revolvers.

BACKGROUND OF THE INVENTION

Various types of loaders are known for loading cartridges into various types of firearms. For example, loaders may be utilized to load cartridges into the cylinders of revolvers. A revolver typically includes a cylinder which has multiple chambers (typically five or six chambers), each of which is configured to accept a bullet cartridge therein for firing of the bullet from the revolver. As is generally understood, the cylinder rotates to align each chamber in turn with a barrel of the revolver. When a trigger is pulled, a hammer of the revolver strikes the cartridge loaded in the aligned cylinder, causing a propellant to ignite and fire a bullet from the cartridge.

A typical loader temporarily retains multiple loaded bullet cartridges for transfer to the cylinder when required. When reloading of the cylinder is required, the cartridges are generally simultaneously released from the loader into the chambers of the cylinder. Many known loaders, for example, include a rotational apparatus which, when twisted, releases the cartridges within the loader and allows them to fall into the cylinder. However, such release apparatus is relatively complicated and can be cumbersome for a user of the loader. Other known loaders, for example, include a linear "strip" which temporarily holds the cartridges until they are released by a user into the chambers of the cylinder. However, known designs of such strips typically do not adequately address the curved alignment of the cylinder chambers in a manner which facilitates efficient cartridge loading.

Another issue with known loaders is that cartridges when retained in a loader are partially exposed. When a user stores a loader for later use, such as in a pocket or purse, the cartridges can become damaged. Further, the cartridges can become caught on other objects, such as within a purse or pocket, hindering efficient removal of the loader.

Accordingly, improved loaders for loading cartridges in revolver cylinders are desired in the art.

BRIEF DESCRIPTION OF THE INVENTION

Aspects and advantages of the invention will be set forth in part in the following description, or may be obvious from the description, or may be learned through practice of the invention.

In accordance with one embodiment, a speed loader assembly for loading cartridges in a revolver cylinder is provided. The speed loader assembly includes a speed loader, the speed loader including a body which defines a plurality of passages, each of the plurality of passages configured to accommodate a cartridge therein. The speed loader assembly further includes a protective casing removably connectable to the speed loader, the casing including a sidewall defining an interior and having a closed polygonal cross-sectional profile. Portions of cartridges extending from the passages are encased by the protective casing.

In accordance with another embodiment, a speed loader for loading cartridges in a revolver cylinder is provided. The speed loader includes a body which defines a plurality of passages, each of the plurality of passages configured to accommodate a cartridge therein. The passages are aligned in a first linear array and a second linear array parallel to the first linear array. A first subset of the plurality of passages are further aligned in a first arc and have an equal angular spacing along the first arc between passages of the first subset. A second subset of the plurality of passages are further aligned in a second arc and have an angular spacing along the second arc between the passages of the second subset that is equal to the angular spacing between the passage of the first subset. A first line from a centerpoint of the first arc through a center of curvature of the first arc and a second line from a centerpoint of the second arc through a center of curvature of the second arc have a converging relationship.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
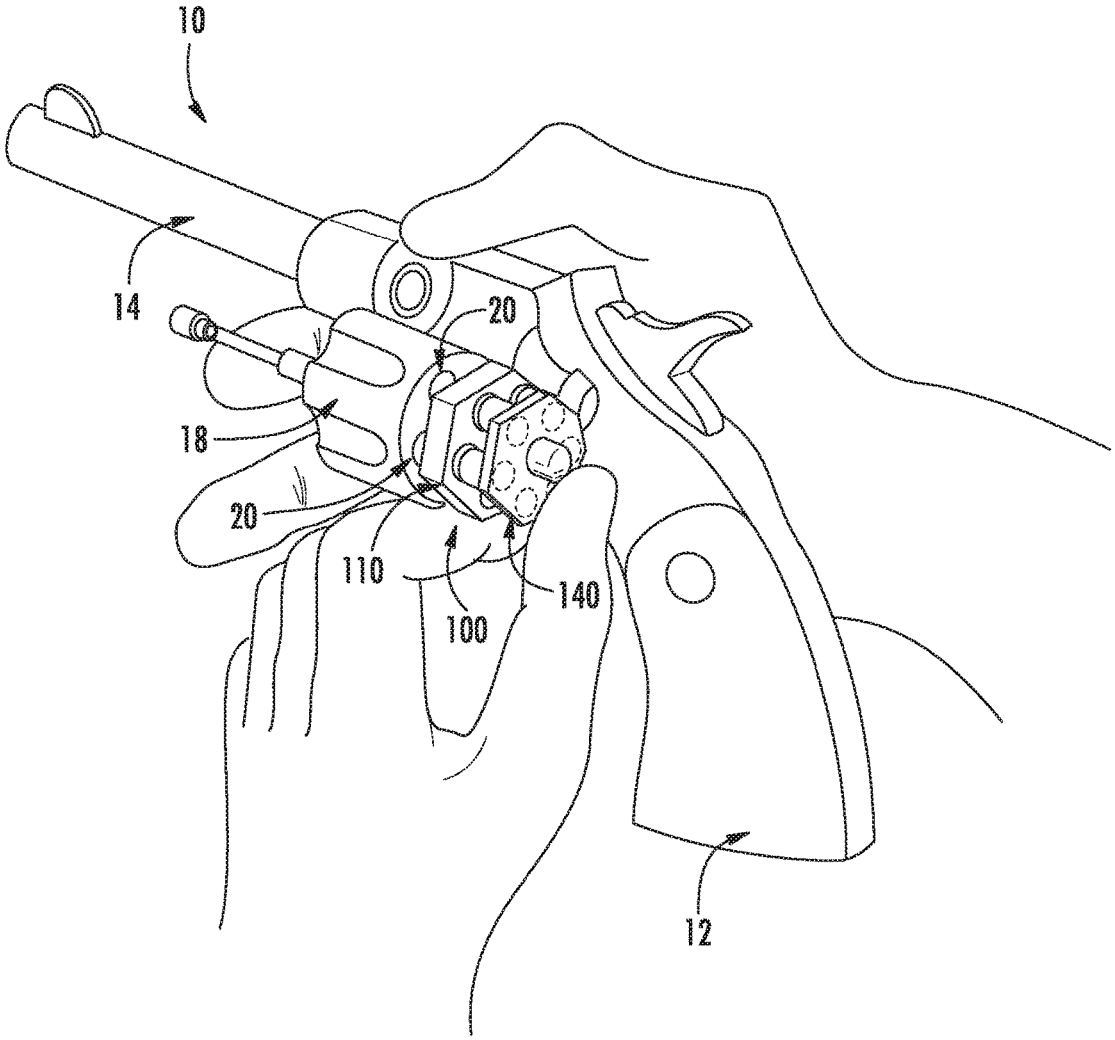
FIG. 1 is a perspective view of a speed loader being utilized to load cartridges into a firearm in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
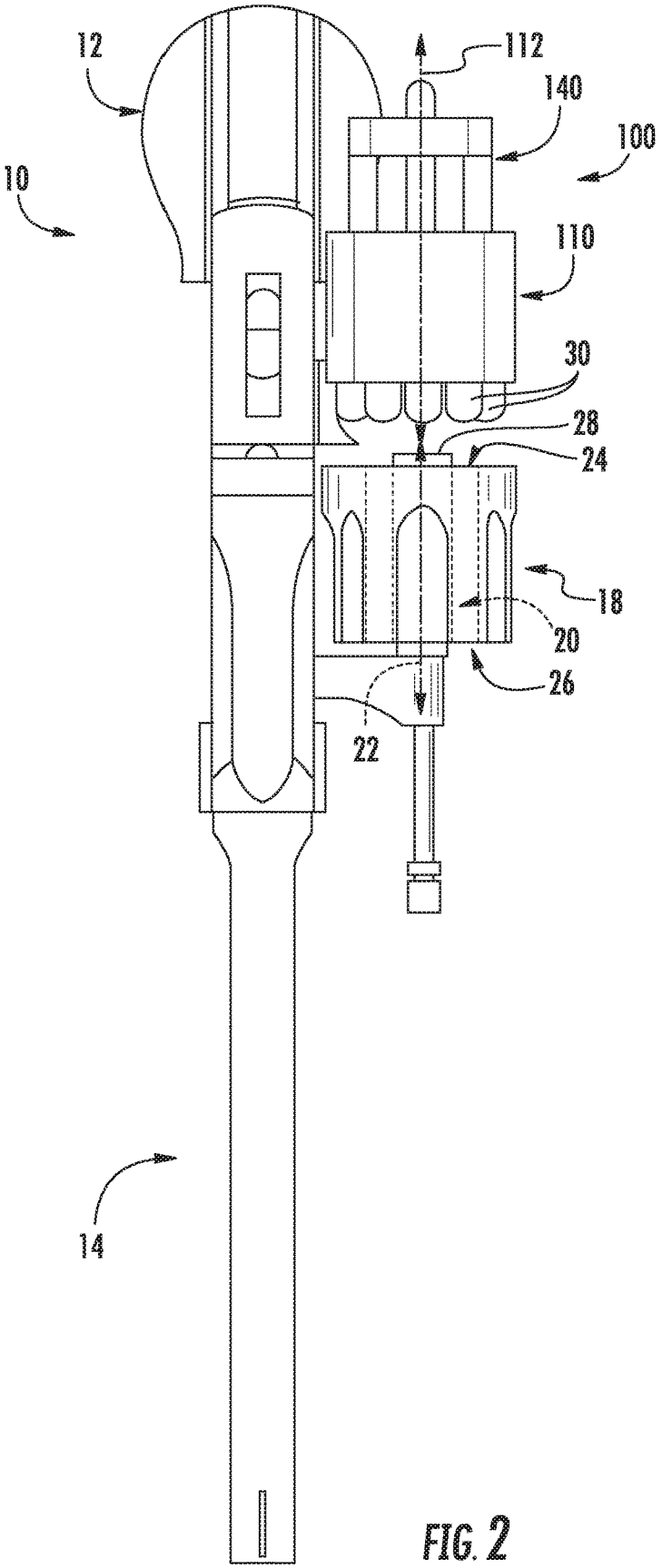
FIG. 2 is a top view of a speed loader being utilized to load cartridges into a firearm in accordance with one embodiment of the present disclosure.

Referring now to FIGS. 1 and 2, embodiments of a firearm 10 are illustrated. Firearm 10 may generally include a grip 12, a barrel 14, a trigger and a cylinder 18. The firearm 10 may conventionally be referred to as a revolver due to the rotational nature of the cylinder 18 about a longitudinal axis, as is generally understood. The cylinder 18 may include a plurality of chambers 20. The chambers 20 may each extend along a longitudinal axis 22 between a first end 24 and a second opposite end 26 of the cylinder 18, and may be disposed in an annular array about the longitudinal axis 22. In exemplary embodiments, five or six chambers 20 may be provided. Alternatively, any suitable number of chambers 20 may be utilized.

Each chamber 20 may be sized and shaped to accommodate therein a cartridge 30. The cartridge 30 may, for example, when initially loaded include a bullet and a propellant therein, as is generally understood. It should be understood that the present disclosure is not limited to any particular caliber cartridge, and rather that cartridges having any suitable caliber, i.e. .22, .38, .45, etc. may be utilized in accordance with the present disclosure. The chambers 20 may be sized and shaped to accommodate the particular caliber cartridge being utilized for a particular application.

Figure 3:
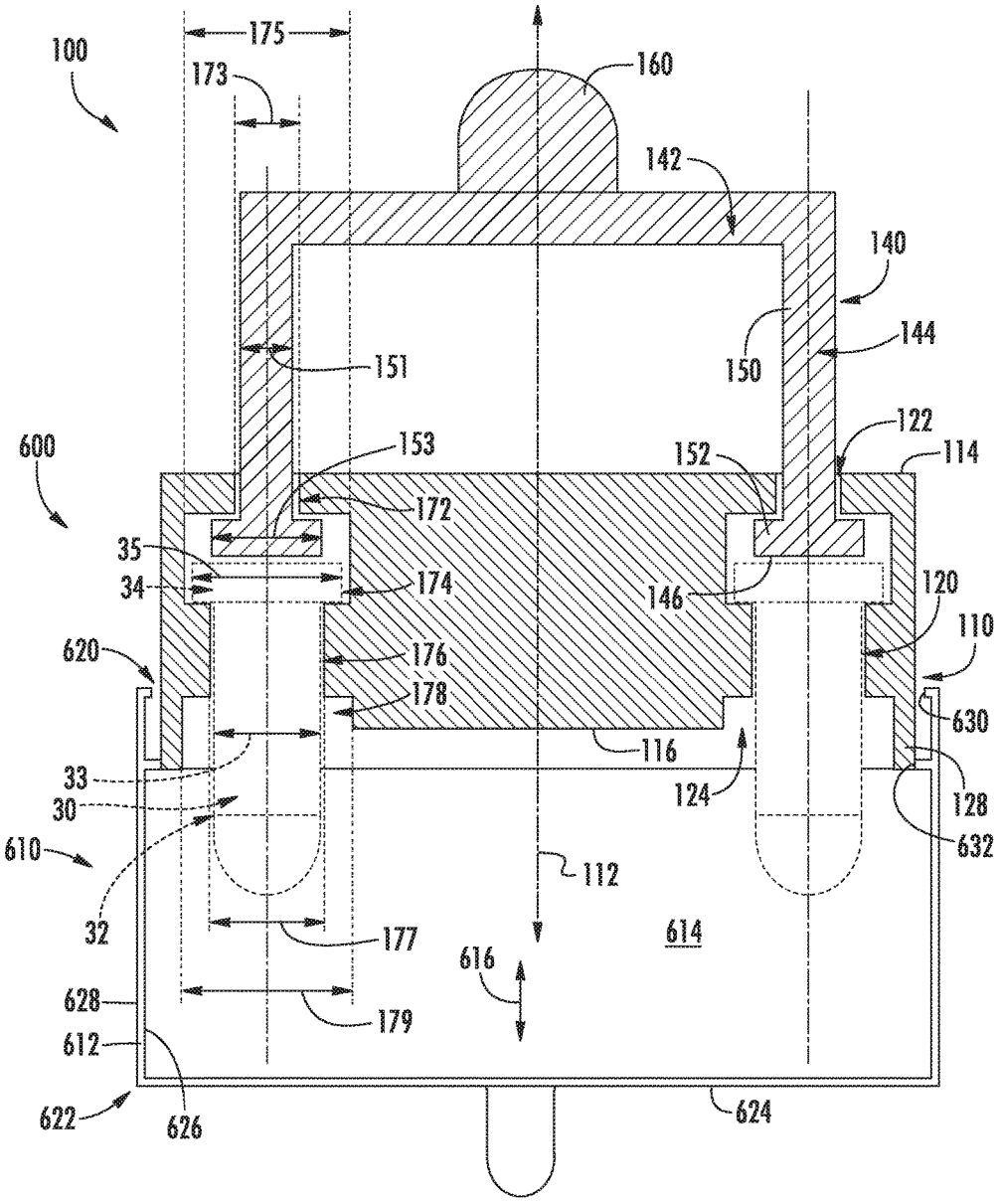
FIG. 3 is a cross-sectional view of a speed loader assembly with a plunger in a first position in accordance with one embodiment of the present disclosure.
Figure 4:
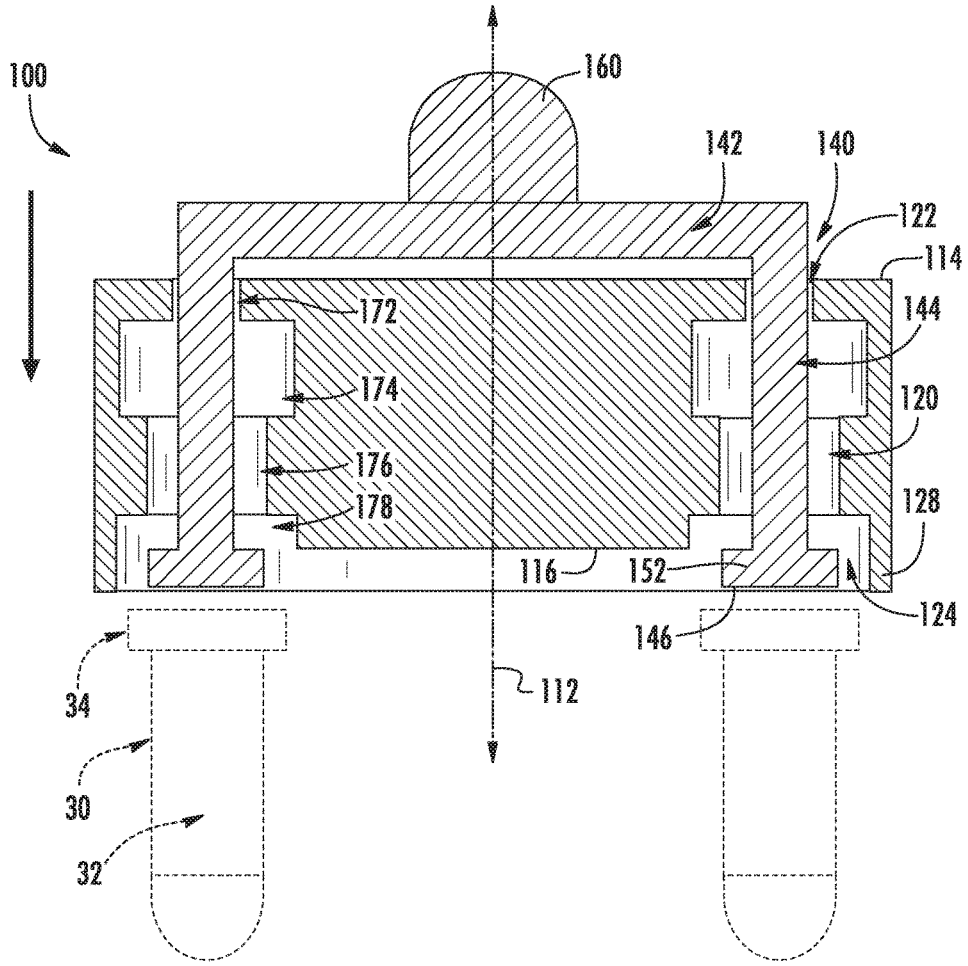
FIG. 4 is a cross-sectional view of a speed loader assembly with protective casing removed and a plunger in a second position in accordance with one embodiment of the present disclosure.

Referring still to FIGS. 1 and 2 as well as to FIGS. 3 and 4, one embodiment of a speed loader 100 for loading cartridges 30 into a revolver cylinder 18 is provided. Such speed loaders 100 advantageously facilitate simple and efficient loading of cartridges 30 into the various chambers 20 of the cylinder 18. In particular, cartridges 30 loaded into the speed loader 100 may be ejected therefrom (and into chambers 20) due to a generally linear force that is applied by a user to the speed loader 100. Notably, no rotational movements or complex rotational-based apparatus are required. In exemplary embodiments, for example, a speed loader 100 in accordance with the present disclosure requires only two components: a main body and a plunger. The main body retains the cartridges 30, and the plunger interacts with the cartridges to eject them from the main body 30, as discussed herein. Additionally, speed loaders 100 in accordance with the present disclosure facilitate improved alignment of the cartridges 30 with the chambers 20 of a cylinder 18 by not rigidly holding the cartridges 30 therein, thus allowing movement of the cartridges 30 within the speed loader 100 to facilitate such alignment. Further, audible rattling of the cartridges 30 within speed loaders 100 in accordance with the present disclosure may in exemplary embodiments be reduced due to the materials utilized to form components of the speed loaders 100, such as elastomers.

A speed loader 100 may include a main body 110 which extends along a longitudinal axis 112 between a first end 114 and a second end 116. In exemplary embodiments, the main body 110 may have a hexagonal or pentagonal cross-sectional shape or may be cylindrical, although other suitable shapes are within the scope and spirit of the present disclosure. A hexagonal cross-sectional shape, for example, may be utilized in embodiments wherein the speed loader 100 facilitates loading of six cartridges. Similarly, a pentagonal cross-sectional shape may be utilized in embodiments wherein the speed loader 100 facilitates loading of five cartridges. These shapes may provide clearance between the speed loader 100 and firearm 10. During operation of the speed loader 100 to eject cartridges 30 into the chambers 20 of a cylinder 18, the longitudinal axis 112 may be approximately aligned, and thus parallel to and in exemplary embodiments co-axial with, longitudinal axis 22.

A plurality of passages 120 may be defined in the main body 110. Each passage 120 may extend along the longitudinal axis 112 between the first end 114 and the second end 116, such that a first opening 122 of each passage 120 is defined in the first end 114 and a second opening 124 of each passage 120 is defined in the second end 116. In exemplary embodiments as shown, each passage 120 is parallel to the longitudinal axis 112, such that an individual longitudinal axis extending through each passage 120 is parallel to the longitudinal axis 112. Further, in exemplary embodiments, the passages 120 may be disposed in an annular array about the longitudinal axis 112. In exemplary embodiments, five or six passages 120 may be provided. Alternatively, any suitable number of passages 120 may be utilized.

The number of passages 120 may in exemplary embodiments be generally identical to the number of chambers 20 of a cylinder 18 with which the speed loader 100 is to be utilized. Further, the spacing of the passages 120 may be generally identical to the spacing of the chambers 20, to facilitate the alignment of passages 120 with chambers 20 in order to eject cartridges 30 from the passages 120 into the chambers 20.

Each passage 120 may be configured to accommodate a cartridge 30 therein. For example, each passage 120 may be sized and shaped such that a cartridge 30 can be inserted into the passage 120, i.e. through the second opening 124 thereof. The cartridge 30 may then, for example, remain housed at least partially within the passage 120 (a tip of the cartridge 30 may for example, extend from the passage 120 through the second opening 124) until ejected therefrom as discussed herein. Notably, the passages 120 may be sized and shaped to accommodate the particular caliber cartridge being utilized for a particular application.

In exemplary embodiments, the main body 110 is formed from an elastomer or other suitable elastic material. As discussed further herein, use of such materials may advantageously allow the cartridges 30 to be housed in the passages 120 and then ejected from the passages 120 due to, for example, a linear force along the longitudinal axis 112. In exemplary embodiments, for example, the material that forms the main body 110, such as the elastomer or other suitable elastic material, may have a Type A Shore hardness of between 70 and 90, such as between 75 and 85, such as between 78 and 82, such as 80. Notably, use of such materials reduces any audible rattle of the cartridges 30 when housed in the main body 110.

Main body 110 may further include a peripheral lip 128 which extends from the second end 116 thereof. The peripheral lip 128 may generally extend from a periphery of the second end 116, and may for example surround the second openings 124. The lip 128 may, for example, contact the cylinder 18, such as a first face of the cylinder 18 in which the first ends 24 of the chambers 20 are defined, for ejecting of cartridges 30 into the chambers 20. Advantageously, the lip 128 may provide a clearance between the second end 116 and an ejector protrusion (conventionally referred to as an ejector star) 28 extending from the first end 24 of the cylinder 18 of the firearm 10. Alternatively, no lip 128 may be utilized and the second end 116 of the main body 110 may contact the first face, or the main body 110 may be spaced from the cylinder 18 during loading of the cartridges 30 into the chambers 20.

A speed loader 100 in accordance with the present disclosure may further include a plunger 140. The plunger 140 may generally be movable linearly, such as along longitudinal axis 112, to eject cartridges 30 from the main body 110 for loading into chambers 20. For example, as discussed herein, a user may apply a force to the plunger 140 to move the plunger 140 in a linear direction relative to the main body 110. Such force may cause the plunger 140 to contact and move the cartridges 30 in linear directions, such as along the longitudinal axis 112, through the passages 120 until they are ejected from the second openings 124 of the passages 120. Notably and advantageously, no rotational forces or actuations are required for release and ejection of the cartridges 30.

As illustrated, plunger 140 may include a plurality of plunger arms 144 which may, for example, each extend from a plunger body 142. Each arm 144 may extend from the body 142 and be extendable into one of the plurality of passages 120 of the main body 110. When the plunger 140 is aligned with the body 110 and portions of the arms 144 are disposed within the passages 120, the arms 144 may for example be parallel to the longitudinal axis 112. In exemplary embodiments, the number of arms 144 utilized with plunger 140 may be identical to the number of passages 120.

Each arm 144 may extend into one of the plurality of passages 120 through the first opening 122 thereof, and may be movable along the longitudinal axis 112 within the associated passage 120. For example, each arm 144 may include a contact surface 146, which may be a surface of the arm 144 that contacts a cartridge 30 within an associated passage 120 to move the cartridge 30 through the passage 120 for ejection therefrom. In exemplary embodiments, a contact surface 146 may be the distal-most surface of an arm 144 relative to the plunger body 142 from which the arm 144, such that the arm 144 extends between the plunger body 142 and the contact surface 146. As illustrated in FIGS. 3 and 4, plunger 140 may be movable along the longitudinal axis 112 between a first position (FIG. 3) and a second position (FIG. 4). In the first position, each of the plurality of contact surfaces 146 may be disposed within a respective passage 120 and proximate the first end 114 of the main body 110 (and first opening 122 of the passage 120) relative to when in the second position. In the second position, each of the plurality of contact surfaces 146 may be disposed within or exterior to the respective passage 120 and distal from the first end 114 of the main body 110 (and first opening 122 of the passage 120) relative to when in the first position. Accordingly, when in the first position relatively less of each arm 144 may be disposed within the associated passage 120 and when in the second position relatively more of each arm 144 may be disposed within the associated passage 120. Each contact surface 146 may, for example, be proximate the first end 114 (and first opening 122) relative to the second end 116 (and second opening 124) in the first position and proximate the second end 116 (and second opening 124) relative to the first end 114 (and first opening 122) in the second position. As each arm 144 moves from the first position to the second position, the contact surface 146 of each arm 144 may contact a cartridge 30 disposed in the associated passage 120. The arm 144 and contact surface 146 may push the cartridge 30 along the longitudinal axis 112 through the passage 120 such that the cartridge 30 is ejected from the passage 120 through the second opening 124 thereof. When the main body 110 is aligned with the cylinder 18, cartridges 30 ejected therefrom may enter the chambers 20 of the cylinder 18, such that the cartridges 30 are loaded into the cylinder 18.

Notably, such movement of the plunger 140 relative to the main body 110 may be caused by a user applying a force to the plunger 140.

In exemplary embodiments, each arm 144 may include a shaft 150 and a head 152. The shaft 150 may, for example, extend from the plunger body 142. The head 152 may extend from the shaft 150, and thus be spaced from the plunger body 142 by the shaft 150. The head 152 may further include the contact surface 146 of that arm 144. As illustrated, the head 152 of an arm 144 may have a width 153 (which may for example be a diameter and which may be a maximum width/diameter) that is greater than a width 151 (which may for example be a diameter and which may be a maximum width/diameter) of the shaft 150. Alternatively, an arm 144 may for example just include a shaft 150, with the contact surface 146 of the arm 144 included on the shaft 150.

Plunger 140 may in some embodiments further include a grip 160. The grip 160 may protrude and thus extend from the plunger body 142, such as in a direction opposite from the plunger arms 144. For example, arms 144 may extend from a face of the plunger body 142, and grip 160 may extend from an opposing face of the plunger body 142. Grip 160 may allow a user to easily grasp the plunger 140, and to apply a force to the plunger 140. For example, the user may apply a force to the plunger 142 by contacting the grip 160 (i.e. with a thumb, finger, etc.) and pressing the grip 160 in a direction towards the main body 110, such as along the longitudinal axis 112.

FIGS. 3 and 4 further illustrate embodiments of various sections of passages 120 of speed loaders 100. The varying sizes of such sections relative to each other may facilitate the accommodation of cartridges 30 by the passage 120 and subsequent ejection of the cartridges from the passages 120. For example, each passage 120 may include a first section 172 which extends (such as along the longitudinal axis 112) from the first end 114 and includes the first opening 122. A second section 174 may extend (such as along the longitudinal axis 112) from the first section 172, and a third section 176 may extend (such as along the longitudinal axis 112) from the second section 174.

In exemplary embodiments, a width 175 (which may for example be a diameter and which may be a maximum width/diameter, and which is measured in an undeformed state) of the second section 174 may be greater than a width 173 (which may for example be a diameter and which may be a maximum width/diameter, and which is measured in an undeformed state) of the first section 172. Additionally, the width 153 of the head 152 may be greater than the width 173 of the first section 172 (and less than the width 175 of the second section 174). Accordingly, once a head 152 is disposed within the second section 174, it may abut against a portion of the main body 110 defining the second section 174, making removal through the first section 172 difficult. As discussed, the main body 110 may be formed from an elastic material. Accordingly, the main body 110 may deform to allow the head 152 through the first section 172 when extending the plunger arm 144 into the passage 120, and may further deform to allow the head 152 to exit the passage through the first section 172, when sufficient force is applied to the plunger 140 (such as along the longitudinal axis 112).

In further exemplary embodiments, width 175 of the second section 174 may be greater than a width 177 (which may for example be a diameter and which may be a maximum width/diameter, and which is measured in an undeformed state) of the third section 176. Additionally, in exemplary embodiments, the width 177 of the third section 176 may be greater than the width 173 of the first section 172. Further, in exemplary embodiments, the width 177 of the third section 176 may be greater than the width 153 of the head 152. The second and third sections 174, 176 may be sized and shaped to accommodate cartridges 30 initially disposed within the passages 120 and to facilitate ejection of the cartridges 30 from the passages 120. For example, as illustrated, a cartridge 30 may include a body 32 and a rim 34. The rim 34 may have a width 35 (which may for example be a diameter and which may be a maximum width/diameter), which may in some embodiments be greater than a width 33 (which may for example be a diameter and which may be a maximum width/diameter) of the body 32. The width 177 of the third section 176 may be less than the width 35 of the rim 34, and the width 175 of the second section 174 may be greater than the width 35 of the rim 34. Accordingly, when a cartridge 30 is loaded into a passage 120, the rim 34 may abut against a portion of the main body 110 defining the second section 174 and cause the cartridge 30 to hang from the second section 174 into and through third section 176. When the plunger arm 144 contacts the cartridge 30 during movement from the first position to the second position, this movement may cause the third section 176 to deform and the cartridge 30 (and rim 34 thereof) to pass through the third section 176 for ejection from the passage 120.

Additionally, in exemplary embodiments, the width 177 of the third section 176 may be greater than the width 33 of the body 32. This may allow the body 32 to move within the passage 120, to facilitate alignment of the cartridge 30 with a cylinder 18 of a chamber 20 into which the cartridge 30 is loaded.

Further, a passage 120 may include a fourth section 178, which may have a width 179 (which may for example be a diameter and which may be a maximum width/diameter, and which is measured in an undeformed state). The fourth section 178 may extend from the third section 176, and may in some embodiments extend to the second end 116 (and thus include the second opening 124 of the passage 120). The width 179 of the fourth section 178 may be greater than the width 177 of the third section 176. Further, the width 179 of the fourth section 178 may in some embodiments be equal to the width 175 of the second section 174. Width 179 may additionally be sized to be greater than the width 35 of the rim 34. Accordingly, when a cartridge 30 is being pushed through the passage 120 for ejection therefrom, it may be released from the passage 120 when the rim 34 enters the fourth section 178 from the third section 176. The rim 34 may no longer be slid against the surface of the main body 110 that defines the third section 176, and may thus for example be free to move (via gravity or further force from the plunger arm 144) from the passage 120. Notably, the widths 177, 179 of the third and fourth sections 176, 178 relative to the rim 34 may advantageously provide the user with a tactile response that can be felt when the cartridge 30 is released from the third section 176 into the fourth section 178 due to the reduction in friction between the rim 34 and the main body 110.

Figure 5:
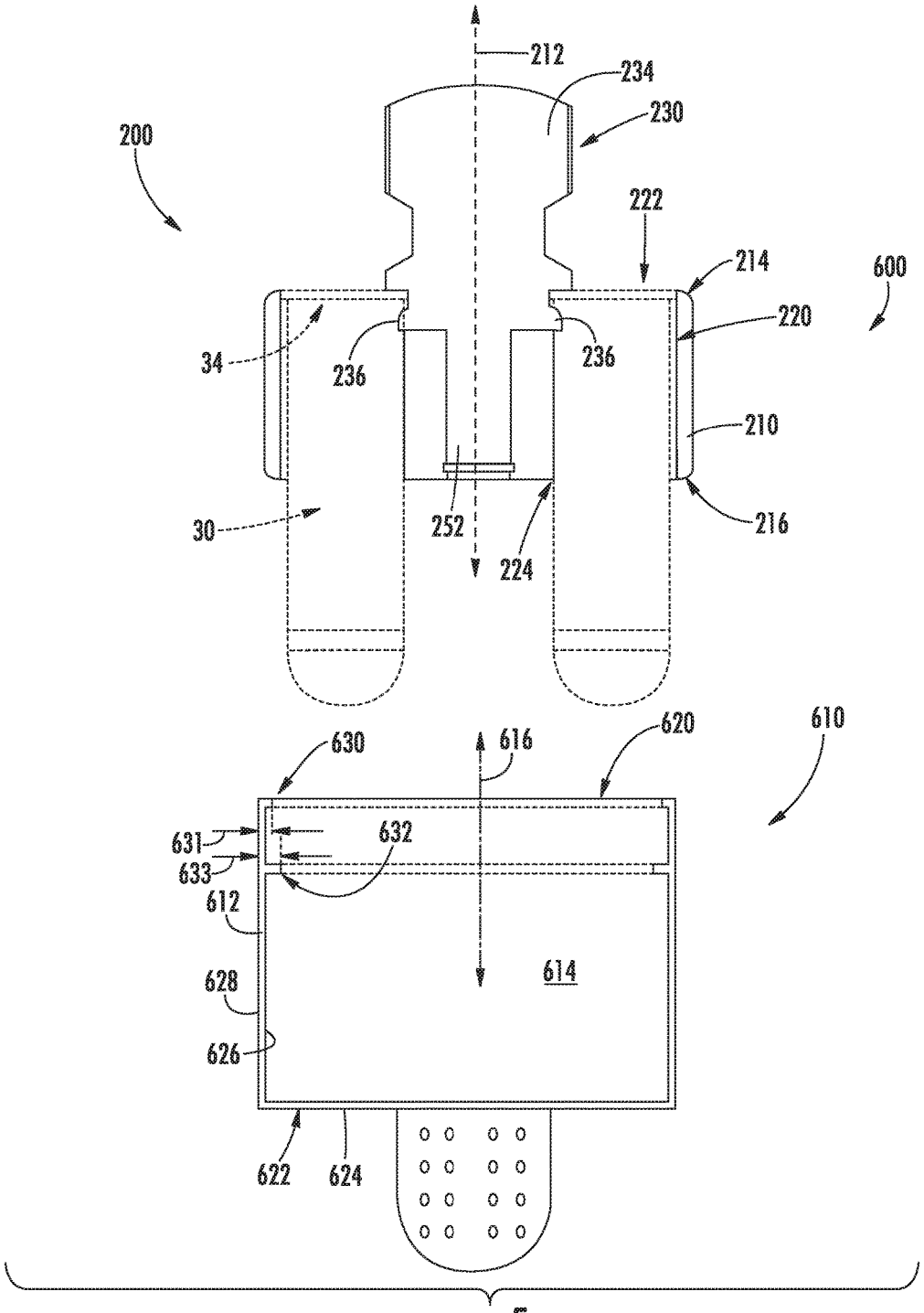
FIG. 5 is a cross-sectional view of a speed loader assembly in accordance with another embodiment of the present disclosure.
Figure 6:
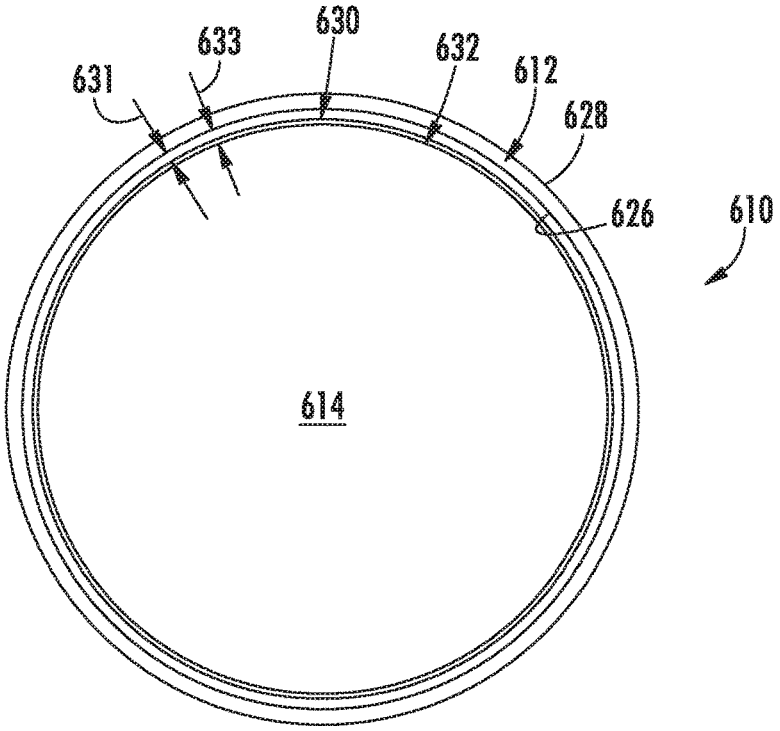
FIG. 6 is a top view of a protective casing of a speed loader assembly in accordance with one embodiment of the present disclosure.
Figure 7:
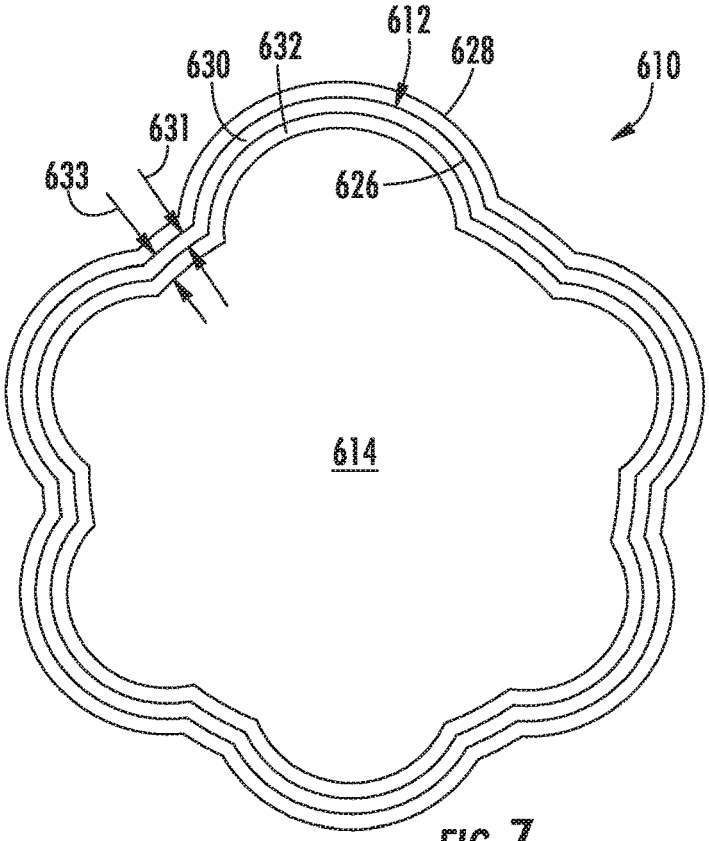
FIG. 7 is a top view of a protective casing of a speed loader assembly in accordance with another embodiment of the present disclosure.

Referring now to FIG. 5, another embodiment of a speed loader 200 for loading cartridges 30 into a revolver cylinder 18 is provided. In this embodiment, rotational movement rather than linear movement is utilized to eject cartridges 30 loaded in the speed loader 200 therefrom. Such speed loaders 200 may include a main body 210 which extends along a longitudinal axis 212 between a first end 214 and a second end 216. In exemplary embodiments, the main body 210 may have a hexagonal or pentagonal cross-sectional shape or may be cylindrical, although other suitable shapes are within the scope and spirit of the present disclosure. During operation of the speed loader 200 to eject cartridges 30 into the chambers 20 of a cylinder 18, the longitudinal axis 212 may be approximately aligned, and thus parallel to and in exemplary embodiments co-axial with, longitudinal axis 22.

A plurality of passages 220 may be defined in the main body 210. Each passage 220 may extend along the longitudinal axis 212 between the first end 214 and the second end 216. A first opening 222 of each passage 220 may be defined in the first end 214. A second opening 224 of each passage 220 is defined in the second end 216. In exemplary embodiments as shown, each passage 220 is parallel to the longitudinal axis 212, such that an individual longitudinal axis extending through each passage 220 is parallel to the longitudinal axis 212. Further, in exemplary embodiments, the passages 220 may be disposed in an annular array about the longitudinal axis 212. In exemplary embodiments, five or six passages 220 may be provided. Alternatively, any suitable number of passages 220 may be utilized.

The number of passages 220 may in exemplary embodiments be generally identical to the number of chambers 20 of a cylinder 18 with which the speed loader 200 is to be utilized. Further, the spacing of the passages 220 may be generally identical to the spacing of the chambers 20, to facilitate the alignment of passages 220 with chambers 20 in order to eject cartridges 30 from the passages 220 into the chambers 20.

Each passage 220 may be configured to accommodate a cartridge 30 therein. For example, each passage 220 may be sized and shaped such that a cartridge 30 can be inserted into the passage 220, i.e. through the second opening 224 thereof. The cartridge 30 may then, for example, remain housed at least partially within the passage 220 (a tip of the cartridge 30 may for example, extend from the passage 220 through the second opening 224) until ejected therefrom as discussed herein. Notably, the passages 220 may be sized and shaped to accommodate the particular caliber cartridge being utilized for a particular application.

Speed loader 200 may further include a rotational release handle 230. The handle may be centrally located relative to the main body 210, such as extending along and coaxial with the longitudinal axis 212. Handle 230 may include a first portion 232 which is disposed within the main body 210 and a second portion 234 which extends from the main body 210. Further, a plurality of spaced apart radial tabs 236 may extend from the handle 230. When cartridges 30 are disposed within the passages 220, the cartridges 30 may be retained by the tabs 236, as shown. In particular, the rim 34 of a cartridge 30 may contact a tab 236, such that the rim 34 (and cartridge 30 generally) is prevented from being ejected from the associated passage 220. To eject a cartridge 30, a user may grasp the handle 230, such as the second portion 234 thereof, and rotationally turn the handle 230 about the longitudinal axis 212. Such movement of the handle 230 may cause movement of the tabs 236 out of contact with the rims 35, such that ejection of the cartridges 30 from the passages 220 is unimpeded. The cartridges 30 may then move (via gravity) from the passages 220 into the chambers 20.

It should be understood that the present disclosure is not limited to the above-described embodiments of rotational-force and linear-force based speed loaders. Rather, any suitable rotational-force based or linear-force based speed loader is within the scope and spirit of the present disclosure.

Figure 12:
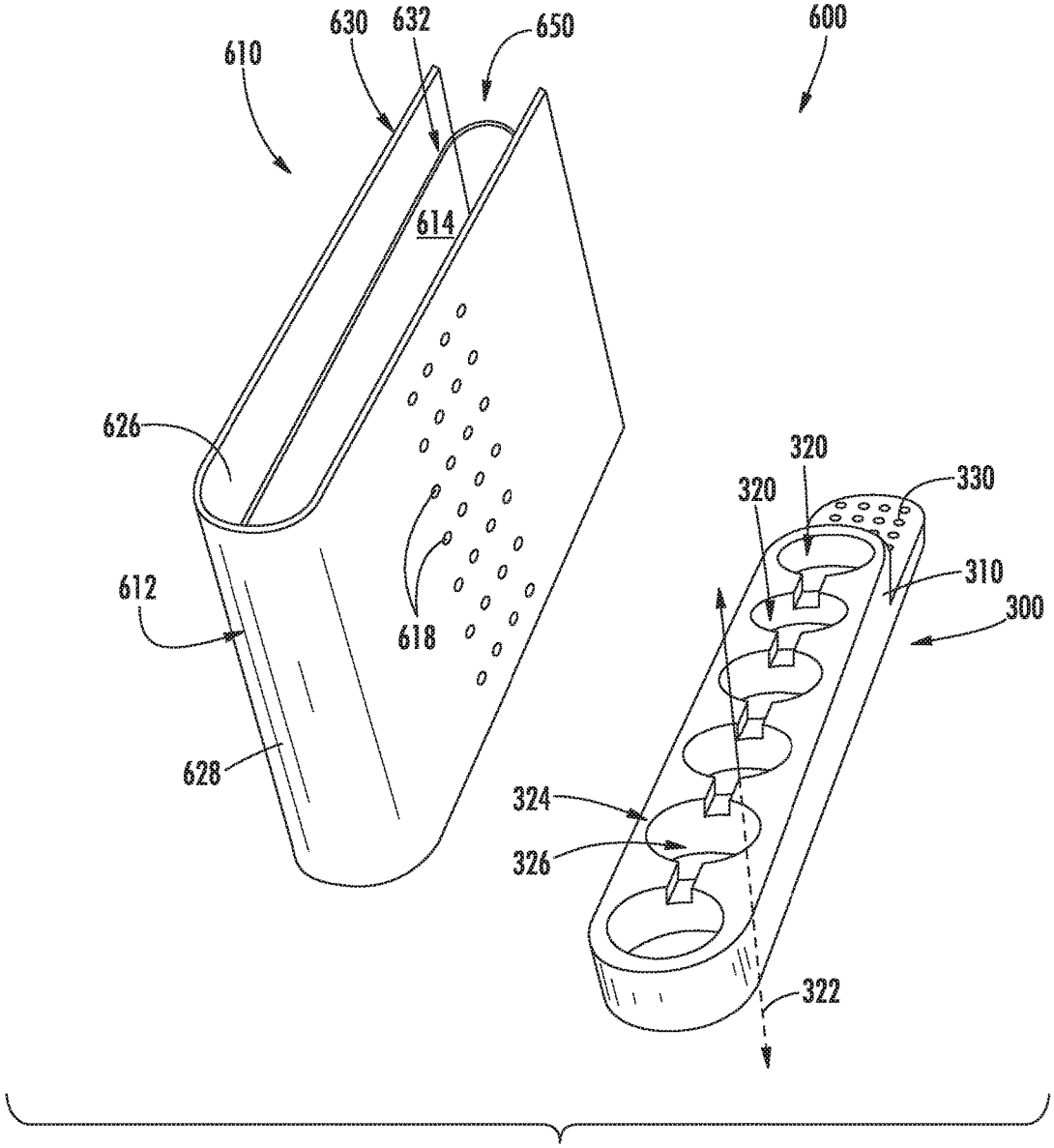
FIG. 12 is a perspective view of components of a speed loader assembly in accordance with another embodiment of the present disclosure.
Figure 13:
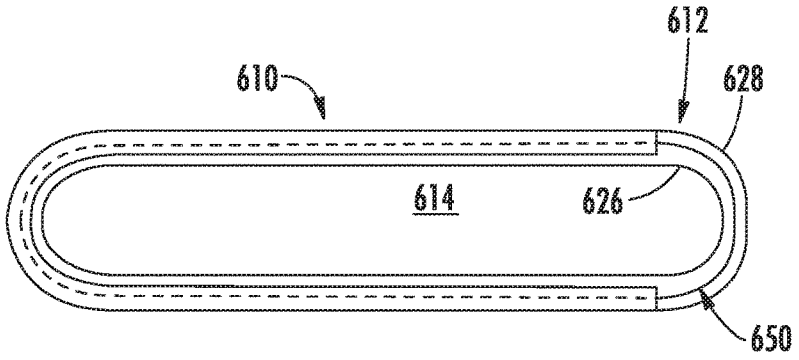
FIG. 13 is a top view of the protective casing of FIG. 12.
Figure 14:
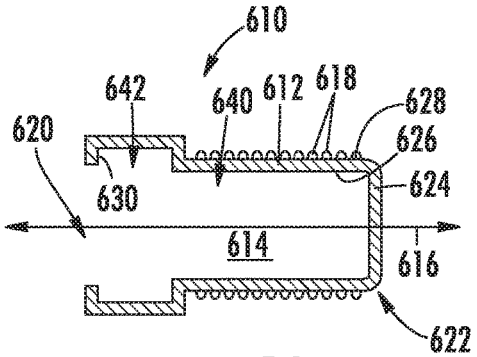
FIG. 14 is an end cross-sectional view of the protective casing of FIG. 12.
Figure 15:
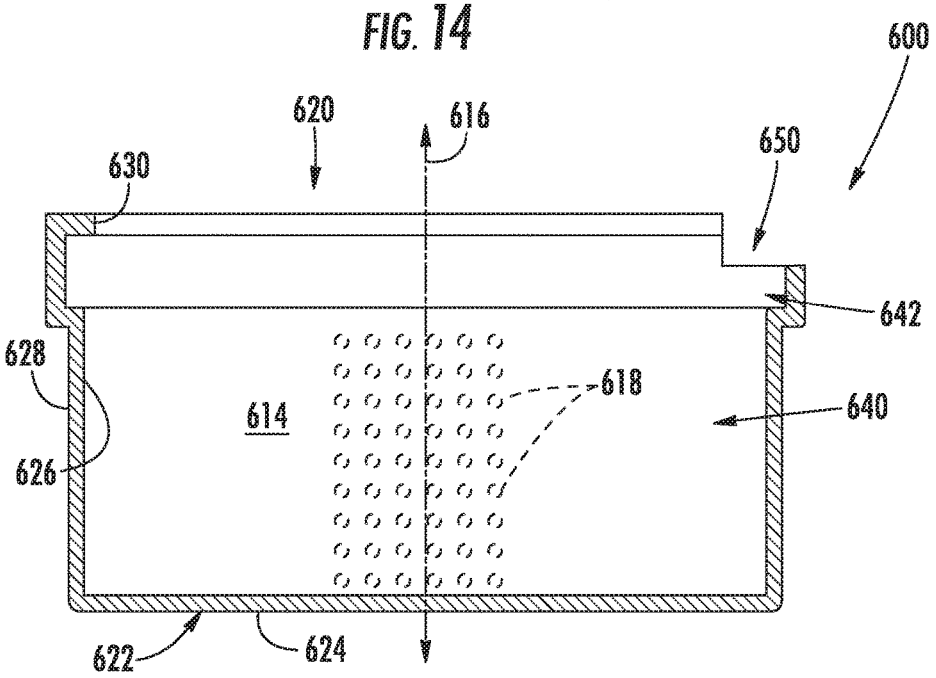
FIG. 15 is an side cross-sectional view of the protective casing of FIG. 12.

Referring now to FIG. 12, another embodiment of a speed loader 300 for loading cartridges 30 into a revolver cylinder 18 is provided. In this embodiment, speed loader 300 includes a body 310 which includes a plurality of passages 320 defined therein. The passages 320 are aligned in a single linear array, as shown. Each passage 320 extends along a longitudinal axis 322 between a first open end 324 and a second closed end 326. The body 310 may be formed from a resilient material, such as from a suitable elastomer such as polyurethane or another suitable polymer. When cartridges 30 are disposed within the passages 320, the cartridges 30 may be retained by the frictional interaction between the body 310 defining each passage 320 and the cartridge disposed therein. To eject a cartridge 30, the user may insert an exposed portion of the cartridge 30 into a chamber 20, and press on the body 310 to release the cartridge 30 from such frictional interaction.

The number of passages 320 may in exemplary embodiments be generally identical to the number of chambers 20 of a cylinder 18 with which the speed loader 300 is to be utilized or may be configured to have a surplus of passages 320, thus allowing clearance spacing between pairs of cartridges 30. Further, as discussed, each passage 320 may be configured to accommodate a cartridge 30 therein. Notably, the passages 320 may be sized and shaped to accommodate the particular caliber cartridge being utilized for a particular application.

Referring now to FIGS. 8 through 11, another embodiment of a speed loader 400 for loading cartridges 30 into a revolver cylinder 18 is provided. Such speed loaders 400 are "strip"-style speed loaders similar to speed loaders 300. However, speed loaders 400 in accordance with the present disclosure provide numerous advantages relative to known "strip"-style speed loaders. In particular, speed loaders 400 advantageously are designed to address the curved alignment of the cylinder chambers 20 of revolvers in a manner which facilitates efficient cartridge 30 loading into such chambers 20. Further, such design advantageously provides an efficient, space-minimizing, and cost-effective arrangement of the passages of such speed loaders 400 while still providing such above advantages.

Figure 11:
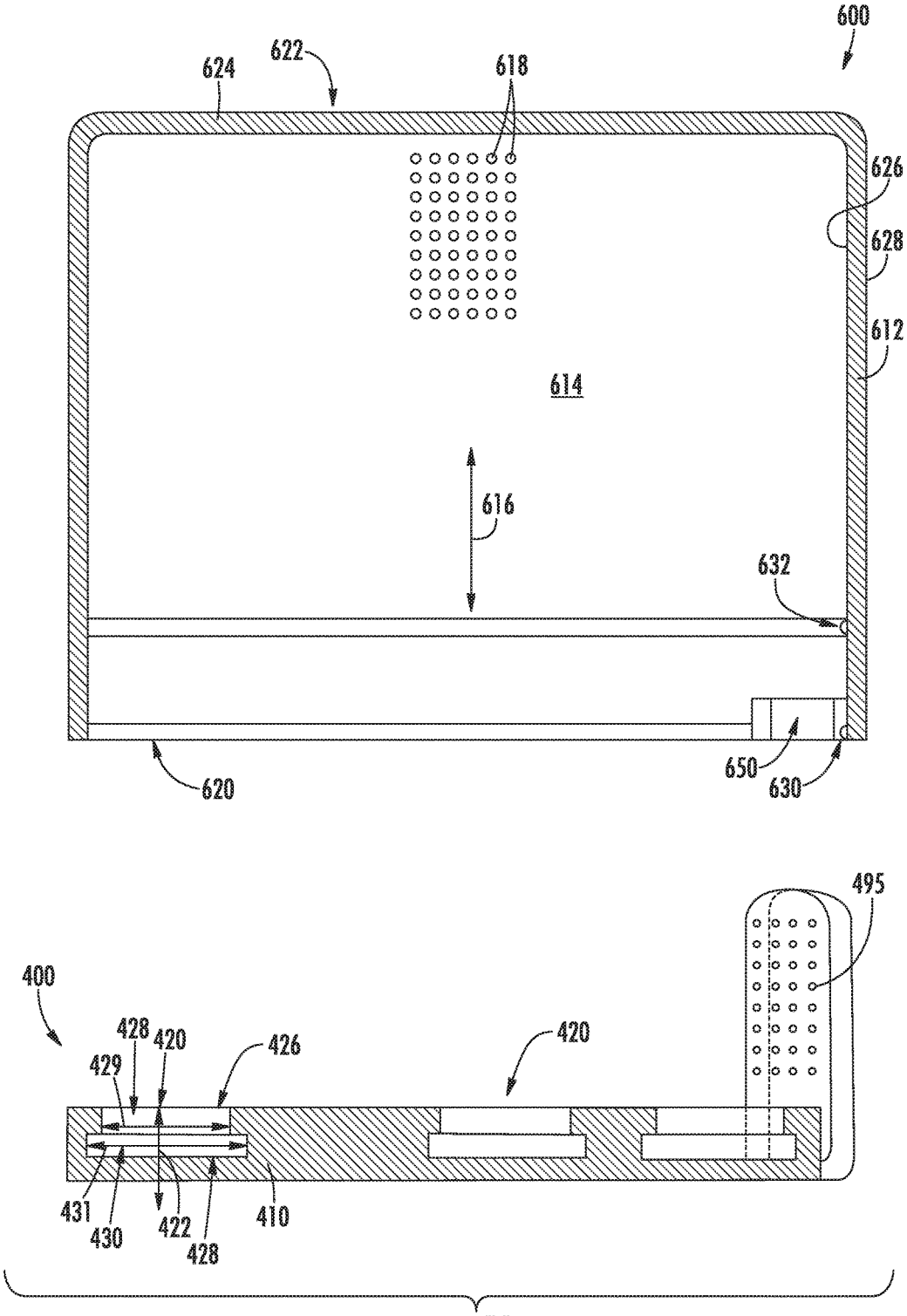
FIG. 11 is a cross-sectional view of a speed loader assembly in accordance with embodiments of the present disclosure.

As shown, speed loaders 400 in accordance with the present disclosure advantageously include a body 410. Body 410 may be formed from a suitable resilient material, such as from an elastomer such as polyurethane or another suitable polymer. In exemplary embodiments, such material may have a Type A Shore hardness of between 90 and 100, such as of between 92 and 98, such as of 95. As shown, a plurality of passages 420 may be defined in the body 410. Each passage 420 may extend along a longitudinal axis 422 between a first open end 424 and a second closed end 426. Further, in some exemplary embodiments as shown in FIG. 11, each passage 420 includes a first section 428 and a second section 430. The first section 428 may extend from the first end 424, such as along the longitudinal axis 422 into the body 410. The second section 430 may extend from the first section 428 to the second end 426, such as along the longitudinal axis 422 into the body 410. In exemplary embodiments as shown, a width 431 of the second section 430 may be greater than a width 429 of the first section 428. When a cartridge 30 is inserted into such passage 420, the rim 34 may be disposed in the second section 430.

When cartridges 30 are disposed within the passages 420, the cartridges 30 may be retained by the frictional interaction between the body 410 defining each passage 420 and the cartridge disposed therein. To eject a cartridge 30, the user may insert an exposed portion of the cartridge 30 into a chamber 20, and press on the body 420 to release the cartridge 30 from such frictional interaction.

Figure 8:
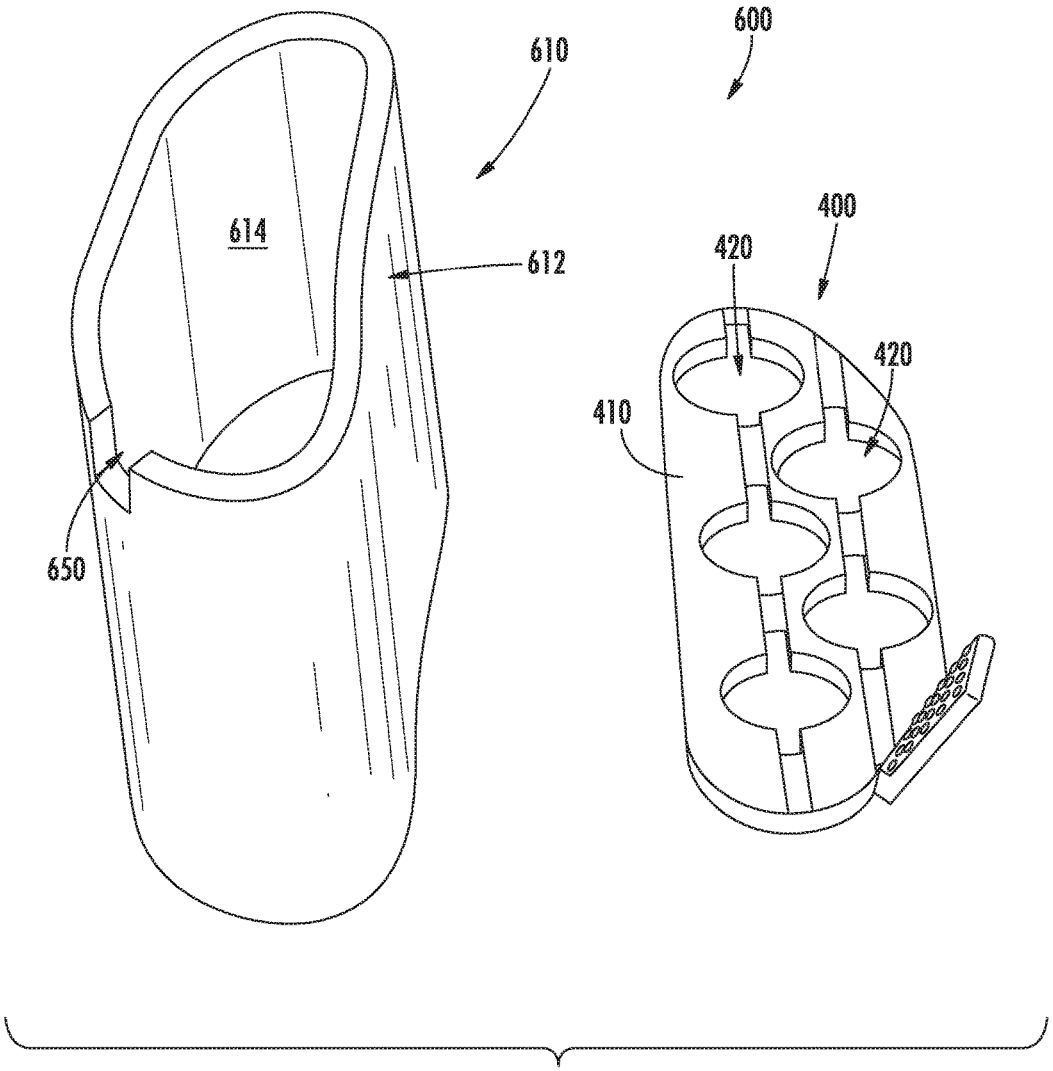
FIG. 8 is a perspective view of components of a speed loader assembly in accordance with another embodiment of the present disclosure.
Figure 9:
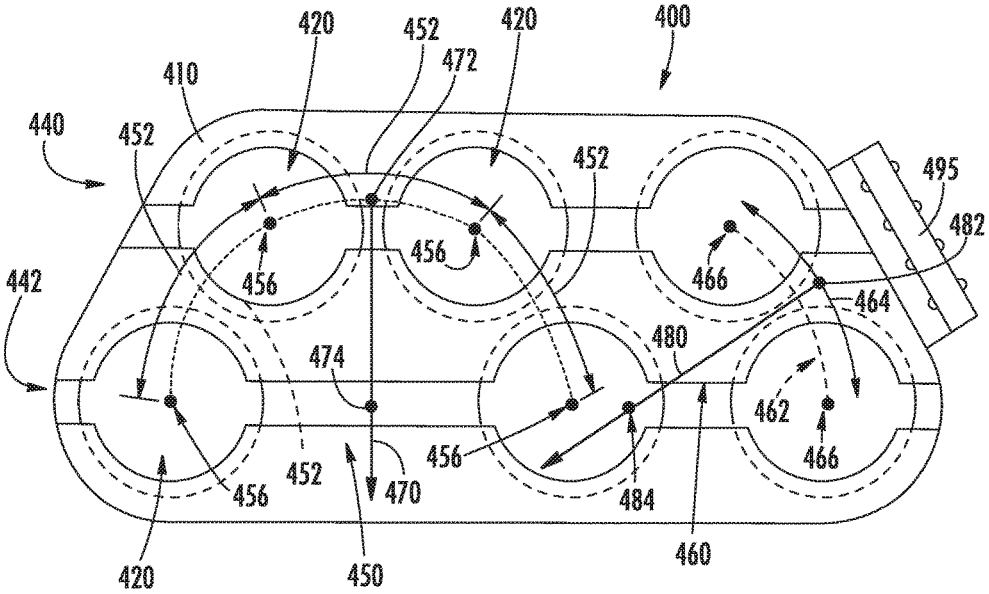
FIG. 9 is a top view of a speed loader in accordance with another embodiment of the present disclosure.
Figure 10:
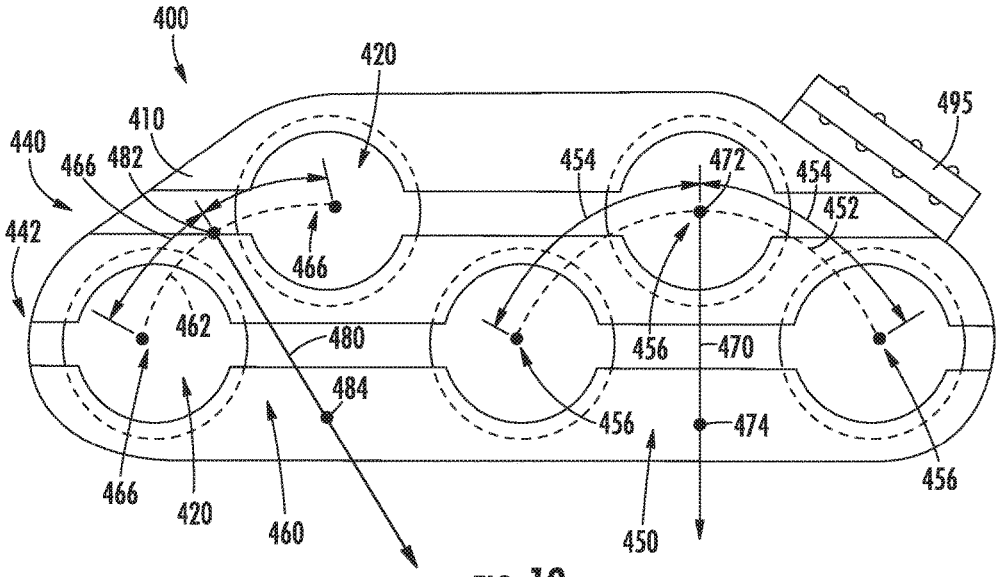
FIG. 10 is a top view of the speed loader of FIG. 8.

In some exemplary embodiments as illustrated in FIGS. 8 and 10, five passages 420 may be defined in the body 410. In other exemplary embodiments as illustrated in FIG. 9, six passages 420 may be defined in the body 410. It should be understood, however, that the present disclosure is not limited to five or six passages. The number of passages 420 may in exemplary embodiments be generally identical to the number of chambers 20 of a cylinder 18 with which the speed loader 400 is to be utilized. Further, as discussed, each passage 420 may be configured to accommodate a cartridge 30 therein. Notably, the passages 420 may be sized and shaped to accommodate the particular caliber cartridge being utilized for a particular application.

As shown, the passages 420 may be aligned in a first linear array 440 and a second linear array 442. The second linear array 442 may be parallel to the first linear array 440. In the embodiment of FIG. 9, each linear array 440, 442 includes three passages 420. In the embodiment of FIGS. 8 and 10, the first linear array 440 includes two passages 420 and the second linear array 442 includes three passages 420. Alternatively, other suitable numbers of passages 420 may be utilized in the first linear array 440 and/or second linear array 442.

Further, as shown, a first subset 450 of the plurality of passages 420 is aligned in a first arc 452. The first subset 450 may include passages 420 from both the first and second linear array 440, 442. The passages 420 in the first subset 450, such as four passages 420 as shown, may have equal angular spacing therebetween along the first arc 452. For example, in some embodiments as illustrated in FIG. 9, an angle 454 between centerpoints 456 of neighboring passages 420 of the first subset 450 may be between 55 degrees and 65 degrees, such as between 57 degrees and 63 degrees, such as 60 degrees. In other embodiments as illustrated in FIGS. 8 and 10, an angle 454 between centerpoints 456 of neighboring passages 420 of the first subset 450 may be between 70 degrees and 75 degrees, such as between 71 degrees and 73 degrees, such as 72 degrees.

A second subset 460 of the plurality of passages 420 (including passages 420 different from those in the first subset 450) is aligned in a second arc 462. The second subset 460 may include passages 420 from both the first and second linear array 440, 442. The passages 420 in the second subset 460, such as two passages 420 as shown, may have an angular spacing therebetween along the second arc 462 that is equal to the angular spacing between the passages 420 along the first arc 452. Accordingly, an angle 464 between centerpoints 466 of neighboring passages 420 of the second subset 460 may be equal to the angle 454.

Still further, a first line 470 may be defined as extending from a centerpoint 472 of the first arc 452 through a center of curvature 474 of the first arc 452. Similarly, a second line 480 may be defined as extending from a centerpoint 482 of the second arc 462 through a center of curvature 484 of the second arc 462. These lines 470, 480 extending in such directions may have a converging relationship, as shown.

Notably, the configuration of passages 420 in only two subsets 450, 460 is particularly advantageous, as it facilitates loading of a revolver, such as a five-shot or six-shot revolver, in only two steps. In the first step, four cartridges 30 (for a six-shot revolver) or three cartridges (30) (for a five-shot revolver) may be loaded. In the second step, two cartridges 30 may be loaded. Still further, the configuration of passages 420 in a converging relationship is particularly advantageous, as it facilitates improved reduction in speed loader size and an increase in the efficiency with which the two-step loading process may be completed. These advantages provide significant improvements upon known loaders, which for example are inefficient and/or require three steps to load the revolver.

Referring now to FIGS. 3, 5-8, and 11-16, embodiments of speed loader assemblies 600 in accordance with the present disclosure are provided. An assembly 600 includes a speed loader, such as a speed loader 100, 200, 300, 400, as described herein. A speed loader assembly 600 may further include a protective casing 610. The protective casing 610 may be removably connectable to the speed loader 100, 200, 300, 400. In particular, when the protective casing 610 is connected to the speed loader 100, 200, 300, 400, exposed portions of the cartridges 30 extending from the speed loaders 100, 200, 300, 400 may be encased by the protective casing 610. Protective casing 610 may thus advantageously protect such cartridges 30 from being damaged or becoming caught on other objects in, for example, a purse or pocket of a user.

The protective casing 610 may be removably connectable to the speed loader 100, 200, 300, 400 via contact between the protective casing 610 at an open end thereof and the body of the speed loader 100, 200, 300, 400. A portion of the casing 610 may contact and surround a portion of the body of the speed loader 100, 200, 300, 400. To remove, a user may simply grasp to the protective casing 610 and pull the casing 610 away from the speed loader 100, 200, 300, 400, thus separating the casing 610 from the speed loader 100, 200, 300, 400.

Protective casing 610 may, for example, be formed from an elastomer such as polyurethane or another suitable polymer. In exemplary embodiments, such material may have a Type D Shore hardness of between 70 and 80, such as of between 72 and 78, such as of 75.

The casing 610 may, as shown, include a sidewall 612 that defines an interior 614 of the casing 610. The sidewall 612 may have a closed polygonal cross-sectional profile, thus defining a full periphery of the interior 614 as shown. Further, in exemplary embodiments as shown, the casing 610 may extend along a longitudinal axis 616 between a first open end 620 and a second closed end 622. The second closed end 622 may, for example, be provided by an end wall 624 as shown or via a tapered or curved portion of the sidewall 612.

Sidewall 612 may have any suitable cross-sectional shape, such as a circle (see FIG. 6), a lobed circle (see FIG. 7), a rounded trapezoid (see FIG. 8), a rounded rectangle (see FIGS. 12-16), etc. The cross-sectional shape may, for example, depend on the shape of the body of the associated speed loader 100, 200, 300, 400, as shown.

Sidewall 612 may include an inner surface 626 which faces the interior 614 and an outer surface 628 opposite the inner surface 626. Further, in some exemplary embodiments, a plurality of raised markers 618 may be disposed on the outer surface 628. The raised markers 618 may provide a grip texture for a user grasping the protective casing 610 for removal or connection thereof.

A protective casing 610 in accordance with the present disclosure may further include a first peripheral tab 630 and/or a second peripheral tab 632. FIGS. 3, 5-7, and 11 illustrate embodiments having a first tab 630 and second tab 632. FIGS. 12-16 illustrate embodiments having only a first tab 630. The tabs 630, 632 may extend into the interior 614 from the inner surface 626. Each tab 630, 632 may extend at least partially around a periphery of the inner surface 626 (perpendicular to the longitudinal axis 616), and in some embodiments may extend around the entire periphery of the inner surface 626.

The first peripheral tab 630 may extend from the inner surface 626 at the first end 620. The second peripheral tab 632 may extend from the inner surface 626 at a location that is spaced from the first tab 630 along the longitudinal axis 616.

The first tab 630 and second tab 632 may each define a height 631, 633, respectively, along the direction extending from the inner surface 626 and perpendicular to the longitudinal axis 616. In exemplary embodiments, the second peripheral tab 632 has height 633 that is greater than the height 631 of the first peripheral tab 630.

In exemplary embodiments as shown in FIGS. 3, 5-7, and 11, the interior 614 or a portion thereof may have a constant cross-sectional area along the longitudinal axis 616. In other words, the cross-sectional area (in a plane perpendicular to the longitudinal axis 616) may be constant at any location along the longitudinal axis 616. Alternatively, the interior 614 may taper or otherwise be non-constant.

In alternative embodiments, as shown in FIGS. 12-16, the interior 614 may include multiple sections. Each section may have a constant cross-sectional area, but the cross-sectional areas of such sections may be different from each other.

For example, in some embodiments as shown in FIGS. 12-15, the interior 614 may have a first section 640 and a second section 642. The second section 642 may extend from the first end 620 along the longitudinal axis 616, and the first section 640 may extend from the second section 642 along the longitudinal axis 616, such as to the second end 622. The second section 642 may have a cross-sectional area that is greater than the cross-sectional area of the first section 640.

Figure 16:
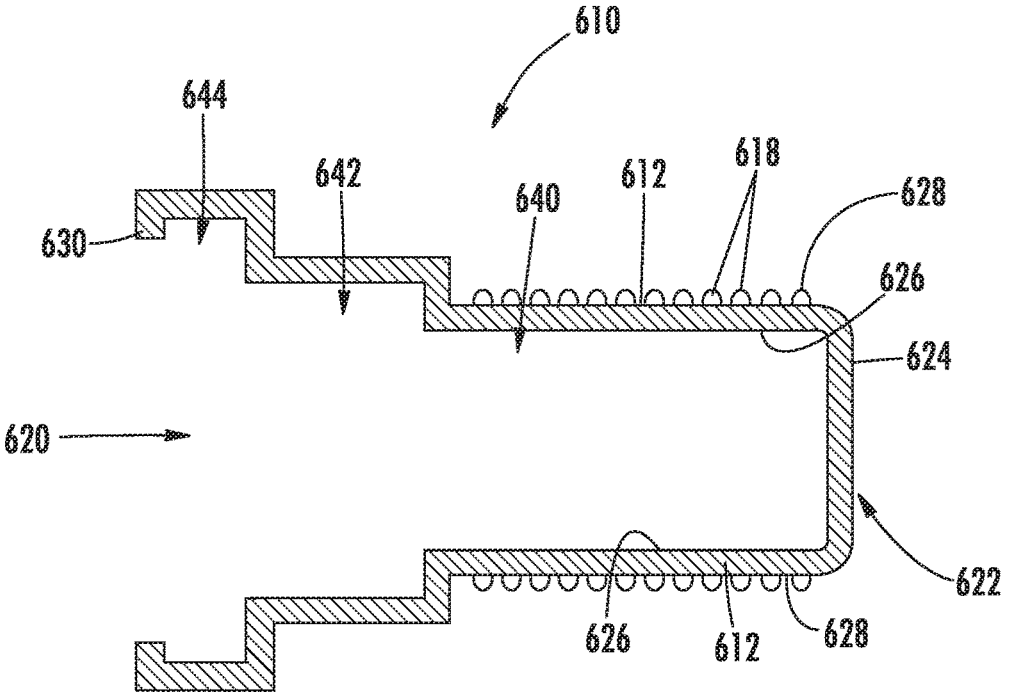
FIG. 16 is an end cross-sectional view of a protective casing in accordance with another embodiment of the present disclosure.

In other embodiments, as shown in FIG. 16, the interior 614 may have a first section 640, a second section 642, and a third section 644. The third section 644 may extend from the first end 620 along the longitudinal axis 616. The second section 642 may extend from the third section 644 along the longitudinal axis 616. The first section 640 may extend from the second section 642 along the longitudinal axis 616, such as to the second end 622. The second section 642 may have a cross-sectional area that is greater than the cross-sectional area of the first section 640. The third section 644 may have a cross-sectional area that is greater than the cross-sectional area of the second section 642 and the first section 640.

In some embodiments, a cutout 650 may be defined in the sidewall 612. The cutout 650 may facilitate a proper connection with an associated speed loader 100, 200, 300, 400 that includes a grip (such as grip 330 or grip 495 as shown) extending from a body thereof and which may otherwise interfere with such connection. For example, This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A speed loader assembly for loading cartridges in a revolver cylinder, each cartridge comprising a body and a rim, the speed loader assembly comprising:

a speed loader, the speed loader comprising a body which defines a plurality of passages, each of the plurality of passages configured to accommodate a cartridge therein, each of the plurality of passages extending along a longitudinal axis between a first open end and a second closed end and comprising a first section and a second section, the first section extending from the first end along the longitudinal axis into the body, the second section extending from the first section to the second end along the longitudinal axis into the body, wherein a width of the second section is greater than a width of the first section, and wherein the second section of each passage is configured to accommodate the rim of a cartridge therein; and a protective casing removably connectable to the speed loader, the casing extending along a longitudinal axis between a first open end and a second closed end and comprising a sidewall defining an interior and having a closed polygonal cross-sectional profile, wherein the interior defines a first section and a second section, the first section of the interior extending from the second section of the interior along the longitudinal axis, the second section of the interior having a cross-sectional area that is greater than a cross-sectional area of the first section of the interior, wherein portions of cartridges extending from the passages are encased by the protective casing.

2. The speed loader assembly of claim 1. wherein the speed loader comprises a linear array of passages.

3. The speed loader assembly of claim 1, wherein the sidewall comprises an inner surface, and wherein the protective casing further includes a first peripheral tab extending from the inner surface into the interior at the first end.

4. The speed loader assembly of claim 3, wherein the protective casing further includes a second peripheral tab extending from the inner surface into the interior, the second peripheral tab spaced from the first peripheral tab along the longitudinal axis.

5. The speed loader assembly of claim 1, wherein the interior has a constant cross-sectional area along the longitudinal axis.

6. The speed loader assembly of claim 1, wherein the interior further defines a third section, the second section of the interior extending from the first section of the interior along the longitudinal axis, the third section haying a cross-sectional area that is greater than the cross-sectional area of the second section of the interior.

7. The speed loader assembly of claim 1, wherein the sidewall comprises an outer surface, and wherein a plurality of raised markers disposed on the outer surface.

* * * * *